US007969303B2

(12) United States Patent
Sullivan

(10) Patent No.: US 7,969,303 B2
(45) Date of Patent: Jun. 28, 2011

(54) SAFETY BARRIER WITH INTEGRATED ALARM

(76) Inventor: Kevin Sullivan, Patchogue, NY (US)

( * ) Notice: Subject to any disclaimer, the term of this patent is extended or adjusted under 35 U.S.C. 154(b) by 185 days.

(21) Appl. No.: 12/221,479

(22) Filed: Aug. 4, 2008

(65) Prior Publication Data

US 2010/0026488 A1 Feb. 4, 2010

(51) Int. Cl.
*G08B 13/00* (2006.01)

(52) U.S. Cl. ..... 340/550

(58) Field of Classification Search ..... 340/550, 340/541, 665, 564, 566
See application file for complete search history.

(56) References Cited

U.S. PATENT DOCUMENTS 4,450,434 A * 5/1984 Nielsen et al. ..... 340/506
4,829,287 A * 5/1989 Kerr et al. ..... 340/541
5,438,316 A * 8/1995 Motsinger et al. ..... 340/541
6,911,900 B1 * 6/2005 Deuss et al. ..... 340/310.11
7,419,140 B2 * 9/2008 Perry ..... 256/2
7,508,340 B2 * 3/2009 Orler et al. ..... 342/357.06
7,675,417 B2 * 3/2010 Eastwood ..... 340/564

* cited by examiner

*Primary Examiner* — Phung Nguyen

(74) *Attorney, Agent, or Firm* — Erik B. Zarkowsky, Esq.

(57) ABSTRACT

A safety barrier with an integrated alarm has a plurality of posts for supporting fencing material. Each post having an inner, portion, an outer portion, an upper portion and a lower portion. The lower portion of each post has embedded therein an alarm contact. A plurality of base supports are used for supporting the posts. Each base support has an interior portion, an exterior portion, a top portion and a bottom portion. The bottom of the interior portion of each base support has an alarm contact embedded therein at the end proximate to the base support which corresponds to the alarm contact embedded in the lower portion of each post.

12 Claims, 6 Drawing Sheets

Fence Post Alarm Contact
Base Support Alarm Contact
12
Transmitter
Receiver
Siren
22
10
18
20
Alarm Off (Inaudible)

10
12
Fence Post Alarm Contact
Base Support Alarm Contact
22
Transmitter
Receiver
Siren
18
20
Alarm On (Audible)

SAFETY BARRIER WITH INTEGRATED ALARM

FIELD OF THE INVENTION

The instant invention relates generally to safety barriers for outdoor use and more particularly to a removable safety barrier with an integrated alarm.

BACKGROUND OF THE INVENTION

Related to the use of a residential swimming pool, spa or Jacuzzi is the risk that someone who is unable to swim, often times an infant, will, without the knowledge of the individual responsible for their supervision, enter into the area surrounding the residential swimming pool, spa or Jacuzzi and fall into the water and drown. Indeed, drowning is a leading cause of death among children under the age of five (5) in many states including Florida, Arizona, and California, just to name a few. Moreover, according to government statistics, for every drowning there are eleven (11) near drowning incidents, many of which result in brain damage or other severe and potentially debilitating injuries.

Drowning typically happens quickly and without warning. There is often no cry for help from the drowning victim. Indeed, a recent study conducted by the U.S. Consumer Product Safety Commission revealed that 77% of the children who drown were seen within five (5) minutes before they were noticed missing and were subsequently discovered in the pool.

Previous efforts to prevent those who are unable to swim from accidentally falling into a residential swimming pool, spa or Jacuzzi and drowning have generally involved the use of either (1) a barrier to prevent access to the residential swimming pool, spa or Jacuzzi, or (2) an alarm which sounds in when one enters the water. Indeed, according to a recent study conducted by the U.S. Consumer Product Safety Commission, 69% of the drowning incidents occurred when parental supervision failed and there were not other safety measures in use. Accordingly, many states and municipalities have enacted legislation which requires persons who construct and/or own swimming pools, spas or Jacuzzis to use some type of protective measure in an effort to prevent children or other individuals who are unable to swim from accidentally falling into the water and drowning.

Pool fences or safety barriers are typically constructed of flexible material which is mounted on aluminum or fiberglass support poles. The support poles are placed into aluminum or plastic sleeves which are installed into the deck surface surrounding the swimming pool, spa, or Jacuzzi. The bottom border of the fence material is typically flush with the deck surface surrounding the swimming pool, spa, or Jacuzzi so as to prevent a child from going under the fence. The device described in U.S. Pat. No. 4,380,327 to Fish describes such a fence.

A standard pool fence is removable in approximately twelve foot sections. Each section can easily be rolled up and is relatively light in weight. The average one hundred foot fence can be removed in less than fifteen (15) minutes and be put back up in approximately the same amount of time.

There are several types of alarms designed for outdoor swimming pools, spas and Jacuzzis. One type of alarm designed for outdoor swimming pools, spas, and Jacuzzis is an alarm which utilizes wave sensors. These types of alarms are essentially floating devices which have remote alarms which are designed sound if someone falls into the water. These alarms are typically mounted on the edge of the swimming pool, spa or Jacuzzi. Generally, these types of alarms sense water displacement when an object weighing more than a certain threshold weight enters the pool. In order to detect a disturbance to the surface of the water, these types of alarms utilize a sensor incorporates an electrical circuit that includes two contacts. One contact rests in the water; the second contact (above-surface contact) is adjusted so that it is resting above the water. When the above-surface contact is touched by water (from a surface wave), the electrical circuit is completed and an alarm sounds. The sensitivity of the device can be adjusted by positioning the above-surface contact closer or further away from the water surface. Sensitivity increases as the contact is positioned closer to the water surface (see FIGS. 1 and 2). In order for such a device to be effective, however, the pool surface must be disturbed enough by the person falling into the water so as to set off the alarm.

Another type of alarm designed for outdoor swimming pools, spas, and Jacuzzis are those which use laser or infra red light to form an unbroken beam of light around the perimeter of the swimming pool, spa or Jacuzzi. When someone entering the perimeter breaks the beam the alarm sounds.

The present invention combines certain desirable features of perimeter barriers and alarms to provide a portable, removable, lightweight device that promotes safety in a manner heretofore unknown.

SUMMARY OF THE INVENTION

According to the present invention, a new safety barrier with an integrated alarm is provided. The various features of novelty which characterize the invention are pointed out with particularity in the claims annexed to and forming a part of the disclosure. For a better understanding of the invention, its advantages, and specific objects attained by its use, reference should be had to the drawings and descriptive matter in which there are illustrated and described preferred embodiments of the invention.

In that drowning typically happens quickly and without warning the device of the instant invention aims to prevent a crisis, rather than to manage a crisis once it's occurred. Accordingly, the device of the instant invention is a removable, self-supporting perimeter fence which contains a plurality of sensors which are connected to a standard closed-system alarm system. In short, the device of the instant invention is designed to sound an alarm to alert an individual if the fence is knocked over, which would likely indicate either that someone outside the perimeter of the fence gained unauthorized access inside the perimeter of the fence or that someone within the perimeter of the fence went outside the perimeter of the fence without authorization.

The device of the instant invention contains the basic elements of a perimeter fence, to with, a plurality of fence posts and fencing material. Fence posts are mounted vertically in the ground or other surface, and consecutively connected horizontally by fencing material to create a barrier the height of the fencing material the distance from fence post to fence post. Fence posts may be arranged in a variety of manners depending on the intended use of the fence.

The device of the instant invention, in addition to a typical perimeter fence as described above, also contains a base support which is mounted directly into the ground surface or a sleeve via a downward extending support assembly in order to provide support for the fence posts, to which the fencing material is attached. When the safety barrier of the instant invention is completely assembled, the fence posts extend vertically and are connected via fencing material. The preferred embodiment of the instant invention includes apertures on the exterior surface of both the fence posts and base support in order to allow the fencing material to be attached from the top of each fence post to the bottom of each base support, which prevents the likelihood that someone or something would be able to slip underneath the fence.

It is recognized that the fencing material of the instant invention may be made of both natural and synthetic materials, such as wood, chain-link or plastic mesh. The preferred embodiment of the instant invention is constructed of lightweight flexible synthetic material.

In order to maintain the fence posts in a vertical position, the base support of the instant invention is a substantially hollow structure which is wider in diameter at its base than at the top thereof. Said fence posts are each mounted inside the hollow portion of a base support. When the fence posts are in a vertical or upright position, the fence posts only contact the bottom portion of the base support, in the center of the base support. More specifically, when the fence posts are in a vertical or upright position, the fence posts do not contact the upper rim of the base support. When force causes the fence posts to become removed from their vertical or upright position however, the fence posts will contact both the inside of the upper rim as well as the bottom portion of the base support. It should be recognized that even when the fence posts are removed from their vertical or upright position, their contact with the inside of the upper rim and the bottom portion of the base support will prevent the fence posts from falling to the ground.

The preferred embodiment of the instant invention contains base supports which are weighted at the bottom portion thereof, in order to prevent the base supports from tipping over and, at the same time, maintain the fence posts in a vertical position.

Moreover, the preferred embodiment of the instant invention contains a horizontal support channel running horizontally through the midsection of said base support through which an object can be inserted, also in an effort to maintain the fence posts in a vertical position. Notably, said horizontal support channel and the object inserted therein are positioned so as to be parallel to the fencing material so as not to prevent the fence from being knocked over should someone or something contact the planar surface of said fencing material.

Alarm contacts or sensors are embedded in both the bottom of each fence post, referred to as fence posts alarm contacts, and the top portion of each downward extending support assembly, referred to as base support alarm contacts. Connected to the fence post alarm contacts and the base support alarm contacts is a transmitter. When the fence posts are in their vertical or upright position, the fence post alarm contact and the base support alarm contact are connected to a transmitter. The transmitter is connected, via a hard wire or wireless connection, to a receiver which is itself connected to a siren capable of sounding an alarm. When the fence posts are in a vertical or upright position, the fence post alarm contact and the base support alarm contact are connected, the electric circuit is closed between the transmitter, the fence post alarm contact and the base support alarm contact, which prevents a siren from sounding. When force causes the fence posts to become removed from their vertical or upright position however, the fence post alarm contact and the base support alarm contact become disconnected, the circuit is opened, thus causing the transmitter to send a signal to the receiver to trigger the siren to sound.

The device of the instant invention is also intended for use for those without residential swimming pools, spas or Jacuzzis. Indeed, the device of the instant invention is duly useful as a portable playpen or kennel, which would sound an alarm if an animal or child knocked over the fence in order to gain access to areas outside the perimeter or, alternatively, if someone or something entered the perimeter.

Other features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF DRAWINGS

In the drawings, wherein similar reference characters denote similar elements through several views.

DETAILED DESCRIPTION OF THE INVENTION

Figure 1:
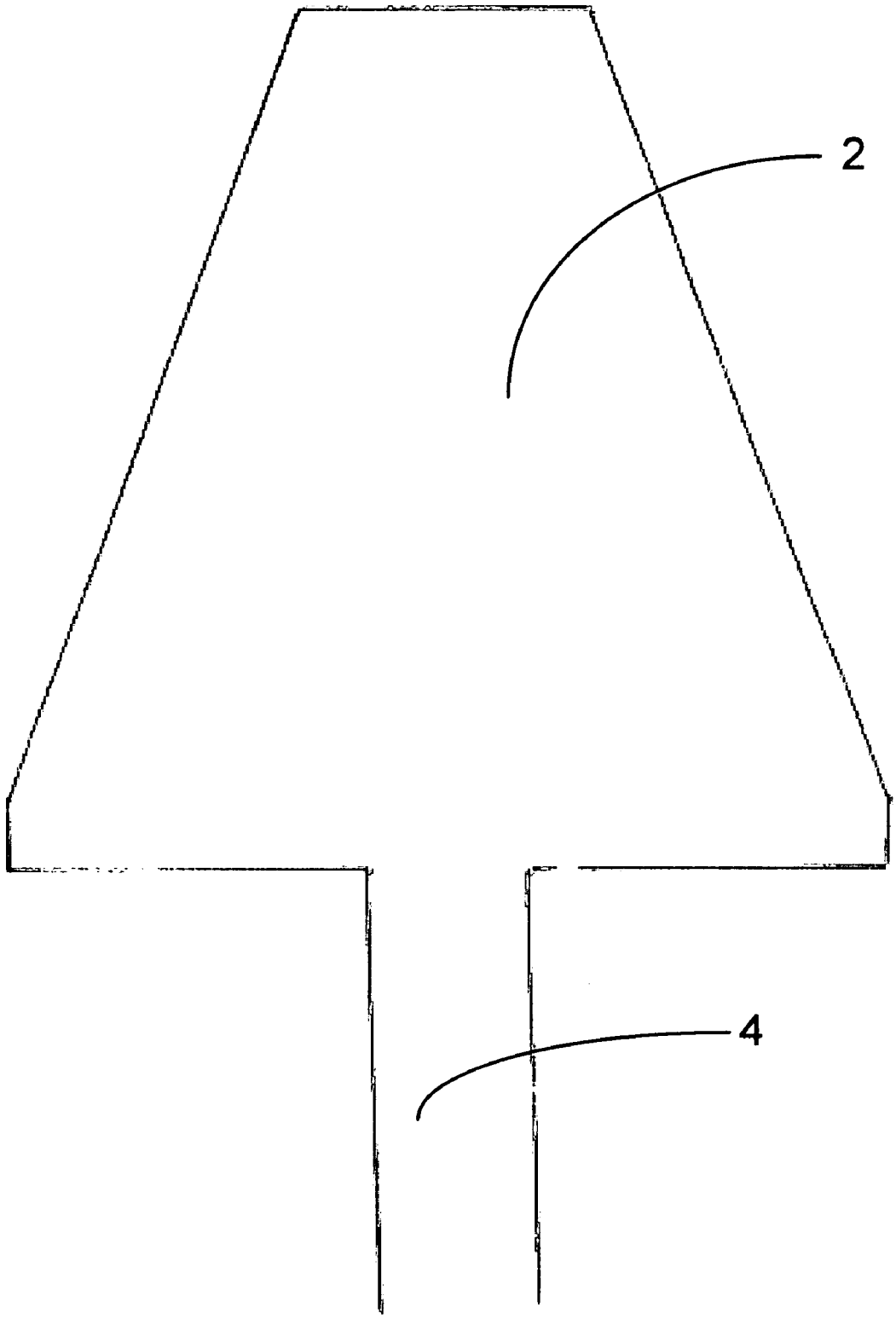
FIG. 1 is a cross-sectional view of the base support and downward extending support assembly of the instant invention.

Referring now to the drawings and particularly to FIG. 1, base support 2, which is mounted directly into the ground surface or a sleeve via downward extending support assembly 4 provides support for fence posts (not shown), to which the fencing material (not shown) is attached. Base support 2 of the instant invention is tapered from bottom to top in order to allow for greater stability when downward extending support assembly 4 is inserted into the ground or a sleeve.

Figure 2:
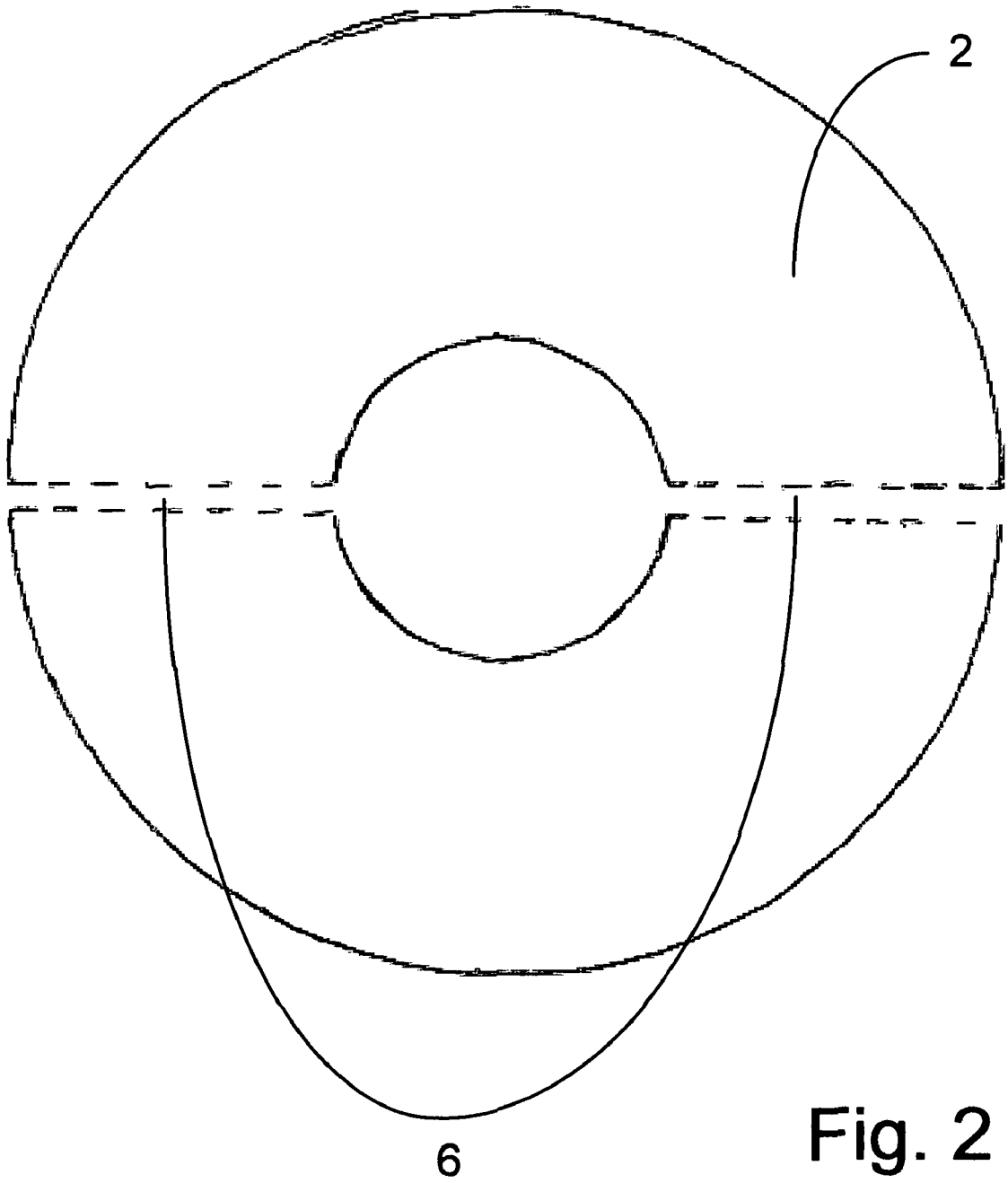
FIG. 2 is a top view of the base support of the instant invention showing the location of the horizontal support channel therein.

Referring to FIG. 2, shown in the preferred embodiment of the instant invention is horizontal support channel 6 which extends horizontally through the midsection of said base support 4. It is recognized that an object, such as a dowel or other long narrow object, can be inserted through horizontal support channel 6 also in order to maintain the fence posts (not shown), through which horizontal support channel 6 also extends, in a vertical position.

Figure 3:
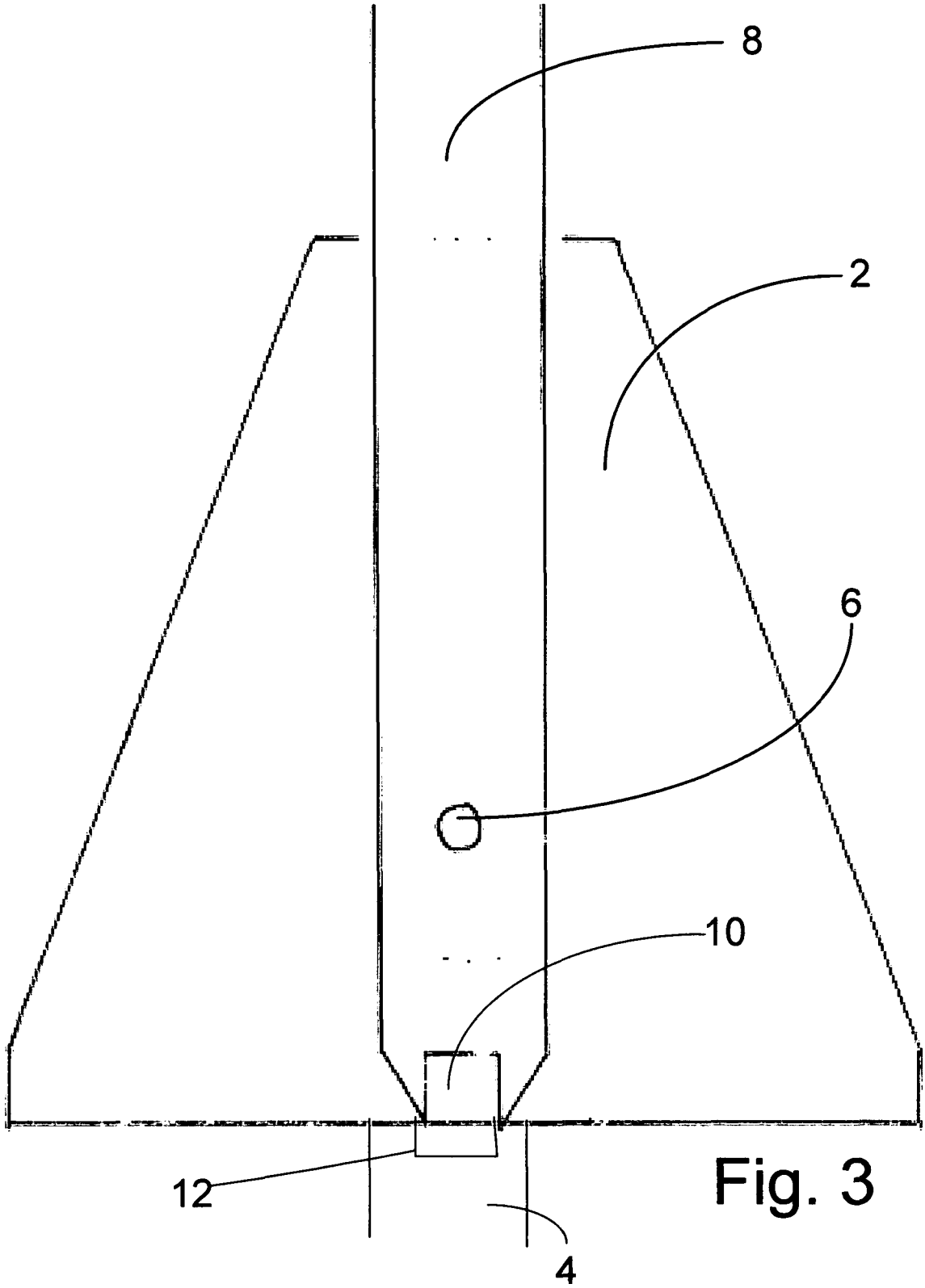
FIG. 3 is a cross-sectional view of the base assembly of the instant invention with the fence post in its upright position.
Figure 4:
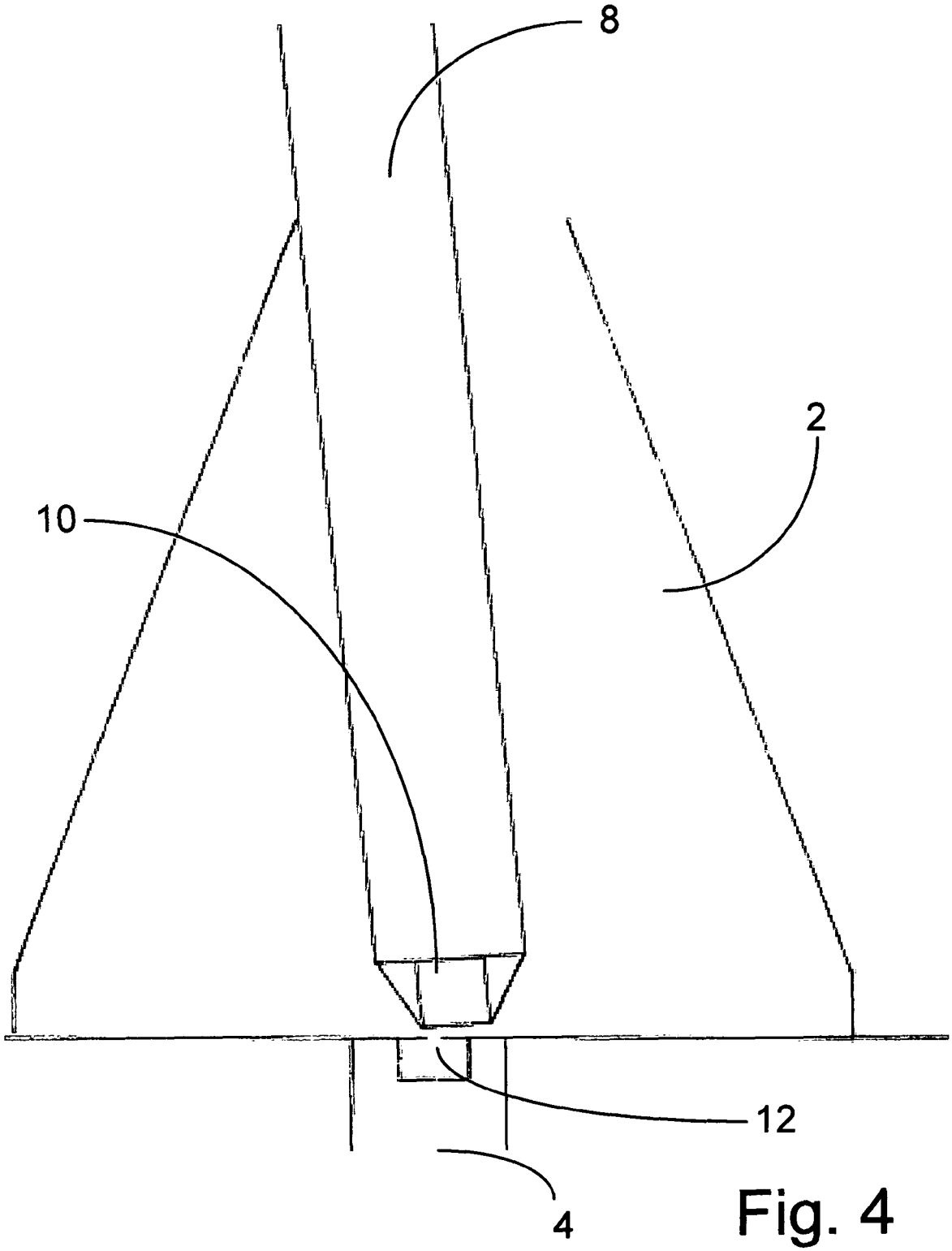
FIG. 4 is a cross-sectional view of the base assembly of the instant invention with the fence post removed from its upright position.

Referring to FIG. 3 and FIG. 4, fence posts 8 are inserted downwardly within base support 4, which is hollow with a an aperture at the top thereof of a size sufficient to receive fence posts 8. Indeed, said fence posts 8 are each mounted inside the hollow portion of a base support 4. When fence posts 8 are in a vertical or upright position, fence posts 8 only contact the bottom portion of base support 4, in the center of thereof, as shown in FIG. 3. More specifically, when fence posts 8 are in a vertical or upright position, fence posts 8 do not contact the upper rim of base support 4. When force causes the fence posts 8 to become removed from their vertical or upright position however, fence posts 8 will contact both the inside of the upper rim as well as the bottom portion of the base support 4, as shown in FIG. 4.

It is recognized that the fence posts of the instant invention may be made of various materials, including both natural and synthetic materials. It is further recognized that using a fence post made of a glow-in-the-dark or other illuminating material in the instant invention provides for increased visibility thereof post-sunset.

Embedded in the bottom of fence post 8 is fence post alarm contact 10. Embedded in the top portion of downward extending support assembly 6, is support alarm contact 12. Fence post alarm contact 10 and support alarm contact 12 are designed so as to co-engage one another and complete the circuit therebetween.

Figure 5:
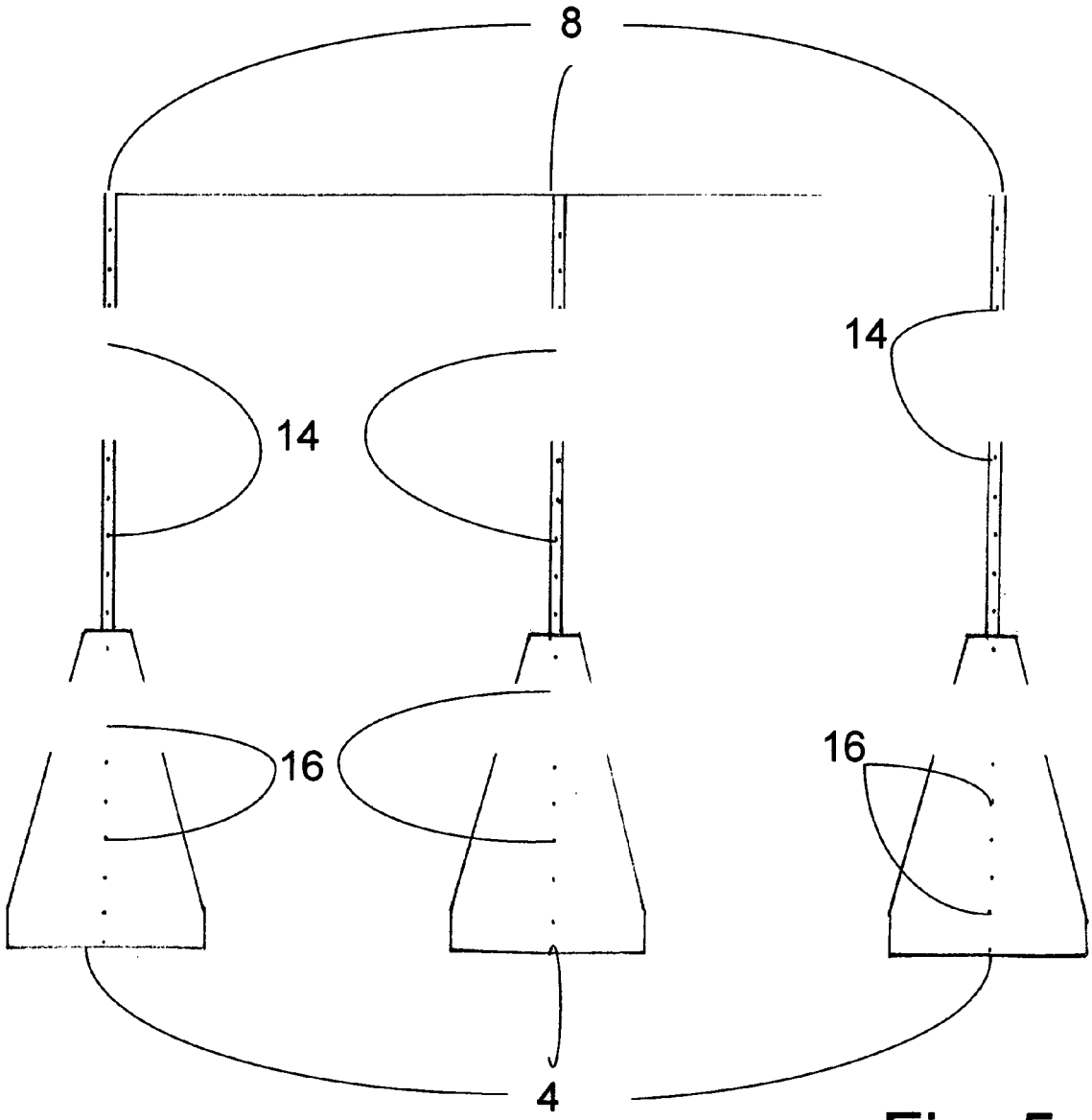
FIG. 5 is an elevational view of the base supports and fence posts of the instant invention in its upright or vertical position.

Referring to FIG. 5, the preferred embodiment of the instant invention includes fence post apertures 14 and base support apertures 6 on the exterior surface of both the fence posts 8 and base supports 2 in order to allow fencing material (not shown) to be attached the full length of each fence post 8 and base support 4.

Figure 6:
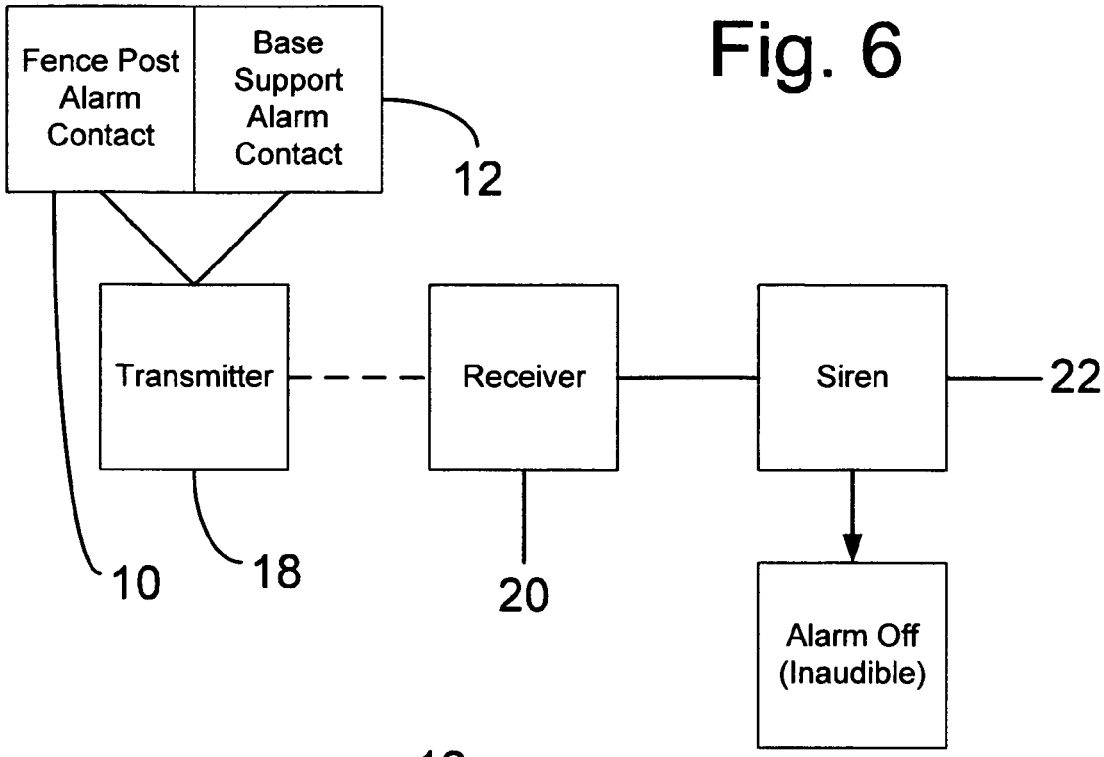
FIG. 6 is a diagram illustrating the effect between the siren and the connection between the fence post alarm contact and the base support alarm contact of the instant invention.
Figure 7:
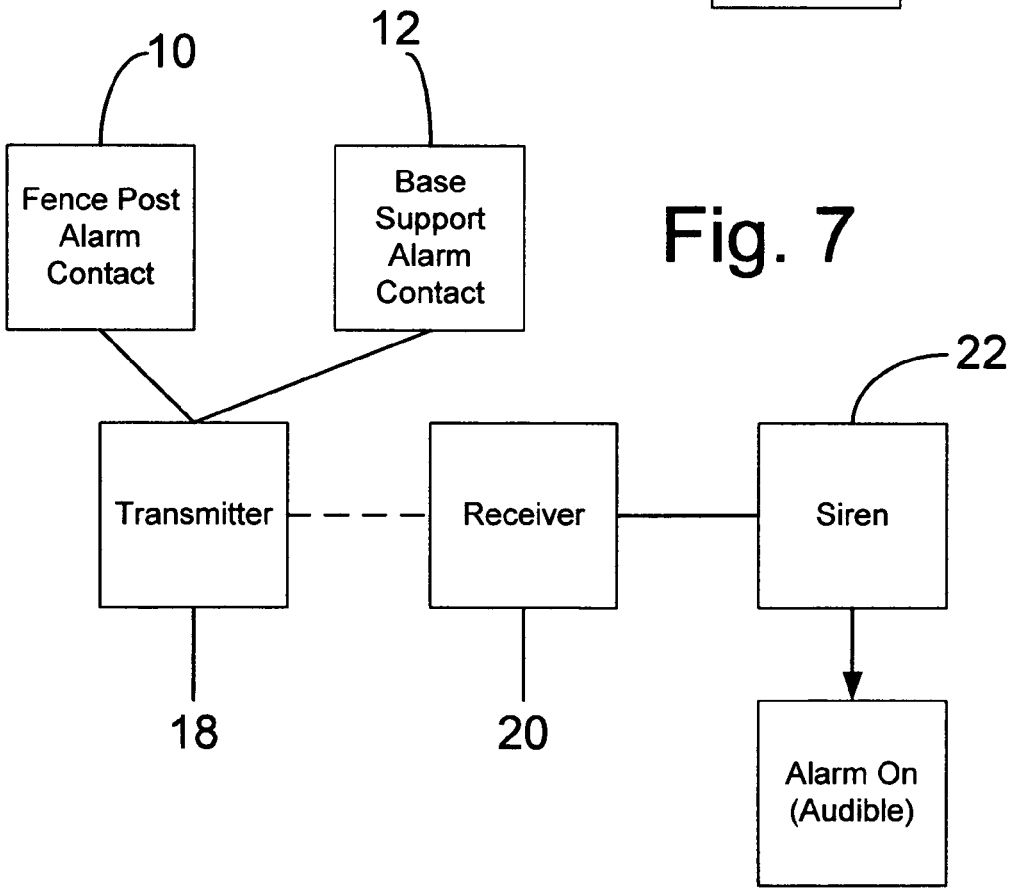
FIG. 7 is a diagram illustrating the effect between the siren and the connection between the fence post alarm contact and the base support alarm contact of the instant invention.

As shown in FIG. 6 and FIG. 7, connected to fence post alarm contact 10 and base support alarm contact 12 is transmitter 18. When fence posts 8 (not shown) are in their vertical or upright position, fence post alarm contact 10 and base support alarm contact 12 are connected to transmitter 18. Transmitter 18 is connected, via a hard wire or wireless connection, to receiver 20 which is itself connected to siren 22, which is capable of sounding an alarm. When fence posts 8 are in a vertical or upright position, fence post alarm contact 10 and base support alarm contact 12 are connected, the electric circuit is closed between transmitter 18, fence post alarm contact 10 and the base support alarm contact 12, which prevents siren 22 from sounding. When force causes fence posts 8 to become removed from their vertical or upright position however, fence post alarm contact 10 and the base support alarm contact 12 become disconnected, the circuit is opened, thus causing transmitter 18 to send a signal to receiver 20 to trigger siren 22 to sound.

While there have been shown, described and pointed out fundamental novel features of the invention as applied to the preferred embodiments thereof, it will be understood that various omissions and substitutions and changes in the form and details of the device illustrated and its operation may be made by those skilled in the art without departing from the spirit of the invention. The invention, therefore, is limited only as indicated by the scope of the claims appended hereto.

I claim:

1. A safety barrier with an integrated alarm comprising: (a) a plurality of posts for supporting fencing material, each post having embedded therein a contact; (b) a plurality of bases for supporting said posts, each base support having a contact embedded therein which corresponds to the contact embedded in said posts; (c) a plurality of bases for supporting said posts; (d) a plurality of bases for supporting said posts; (e) at least one alarm connected to the contacts embedded in the bases and posts; and (f) fencing material; wherein said posts are inserted into said bases, which are consecutively arranged, to support said posts in an upright position; said fencing material is supported horizontally on said posts, extending from post to post; wherein when said posts are in an upright position, said contacts embedded in said post and said base are connected, which closes the circuit between said alarm and said alarm contacts embedded in said post and said base, which prevents said alarm from emitting sound; and conversely, when said posts are not in an upright position, said contacts embedded in said post and said base become disconnected, which opens the circuit between said alarm and said alarm contacts embedded in said post and said base, which causes said alarm to emit sound.

2. The safety barrier with an integrated alarm as set forth in claim 1, wherein the connection between: (a) the contacts embedded in said post and said base; and (b) the contacts embedded in said post and said base and said alarm can be via either a physical or wireless connection.

3. The safety barrier with an integrated alarm set forth in claim 2, wherein said base has an extension continuing downward from the bottom portion of said base for mounting in a ground surface or sleeve.

4. The safety barrier with an integrated alarm set forth in claim 2, wherein said alarm consists of: (a) at least two contacts; (b) at least one transmitter connected to said alarm contacts; (c) at least one receiver for receiving signals transmitted from said transmitter; (d) at least one sound emitting device connected to said receiver for creating sound.

5. The safety barrier with an integrated alarm set forth in claim 2, wherein the connection between: (a) said contacts and said transmitter; (b) said transmitter and said receiver; and (c) said receiver and said sound emitting device can be via either a physical or wireless connection.

6. The safety barrier with an integrated alarm set forth in claim 2, wherein a channel extends horizontally through said bases and said posts to allow for the insertion of an object with a diameter less than said channel through said base and said post.

7. The safety barrier with an integrated alarm set forth in claim 2, wherein said posts said bases contain apertures to allow said fencing material to be attached from the full length of each post and base.

8. A safety barrier with an integrated alarm comprising: (a) a plurality of posts for supporting fencing material, each post having an inner portion, an outer portion, an upper portion and a lower portion, wherein the lower portion of said post has embedded therein an alarm contact; (b) a plurality of bases for supporting said posts, each base support having an interior portion, an exterior portion, a top portion and a bottom portion, wherein the bottom of the interior portion of said base has an alarm contact embedded therein at the end proximate to said base which corresponds to the alarm contact embedded in said lower portion of said post; (c) a plurality of bases for supporting said posts, wherein the exterior portion of said base has an extension continuing downward from the bottom portion of said base for mounting in a ground surface or sleeve; (d) a plurality of bases for supporting said posts, wherein the top portion of said base contains an aperture having a diameter greater than said fence post; (e) a plurality of bases for supporting said posts, wherein the bottom portion of said base is greater in diameter than said top portion of said base; (f) at least one transmitter for transmitting a signal to a receiver; (g) at least one receiver; (h) at least one sound emitting device connected to said receiver for creating an audible alert; and (i) fencing material connecting said posts; wherein said posts are inserted into said bases, which are consecutively arranged, to support said posts in an upright position; said fencing material is supported horizontally on said posts, extending from post to post; wherein connecting said alarm contacts embedded in said lower portion of said post and the bottom of the interior portion of said base closes the circuit between said transmitter, and said alarm contacts embedded in said lower portion of said post and the bottom of the interior portion of said base, which prevents said sound emitting device from emitting sound; and disconnecting said alarm contacts embedded in said lower portion of said post and the bottom of the interior portion of said base opens the circuit, which causes said transmitter to send a signal to said receiver to trigger said sound emitting device to emit sound.

9. The safety barrier with an integrated alarm set forth in claim 8, wherein the connection between; (a) the contacts embedded in said post and said base; (b) the contacts embedded in said post and said base and said transmitter; (c) said transmitter and said receiver; (d) said receiver and said sound emitting device can be via either a physical or wireless connection.

10. The safety barrier with an integrated alarm as set forth in claim 9, wherein said base has an extension continuing downward from the bottom portion of said base for mounting in a ground surface or sleeve.

11. The safety barrier with an integrated alarm as set forth in claim 9, wherein a channel extends horizontally through said bases and said posts to allow for the insertion of an object with a diameter less than said channel through said base and said post.

12. The safety barrier with an integrated alarm as set forth in claim 9, wherein said posts said bases contain apertures to allow said fencing material to be attached from the full length of each post and base.

* * * * *